United States Patent [19]

Guiana

[11] 4,258,510

[45] Mar. 31, 1981

[54] RAIN WATER DEFLECTOR

[76] Inventor: Leonard T. Guiana, 1416 S. Minnesota Ave., Sioux Falls, S. Dak. 57105

[21] Appl. No.: 82,907

[22] Filed: Oct. 9, 1979

[51] Int. Cl.[3] ..... E04D 13/00

[52] U.S. Cl. ..... 52/11; 52/16

[58] Field of Search ..... 52/11, 16

[56] References Cited

FOREIGN PATENT DOCUMENTS 841166 7/1960 United Kingdom ..... 52/16

*Primary Examiner*—Carl D. Friedman

[57] ABSTRACT

A device for attachment to roof beams to deflect rain water running from those beams comprising a metal or plastic deflector attachable to the beam but opened from the beam forming a trough into which rain water will run and a deflector trough in communication with the deflector to carry the water to a proper drainage point.

5 Claims, 3 Drawing Figures

RAIN WATER DEFLECTOR

BACKGROUND AND SUMMARY OF THE INVENTION

This invention pertains to means for deflecting rain water from a roof and more particularly to a device for catching stray water which drains from a roof onto the roof beams and redirecting that water to a desired drainage location.

Rain water is normally drained from sloping roofs by gutters or eave troughs attached to the lowest edges of the roof and thence to downspouts which discharge the water in a selected place where it will run away into the ground. This system works well for the most part.

However, many gutters extend only to but not across the end beam of the roof. That situation leaves a sort of an edge which seems to collect a certain amount of water and direct it along the beam. Frequently this results in the discharge of a stream of water from the end beam onto a place unsuitable or at least undesirable for the drainage of such a stream of water.

By my invention, I provide a means for collection and redirection of the water to a more desirable drainage spot.

FIGURES

Figure 1:
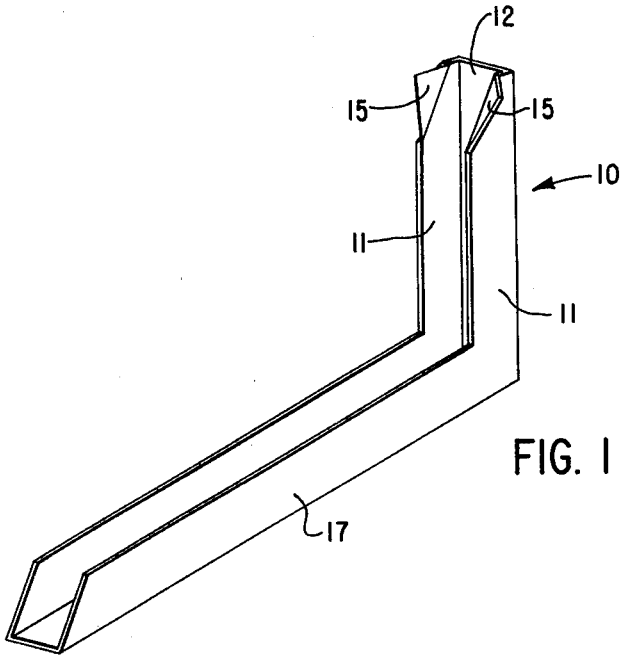
Figure 2:
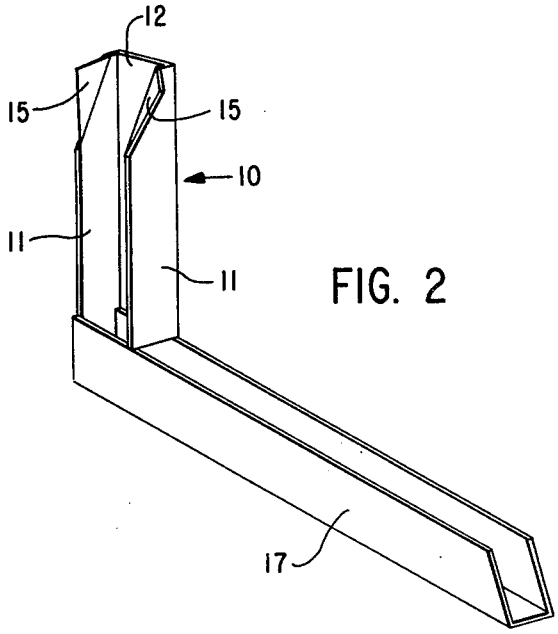
Figure 3:
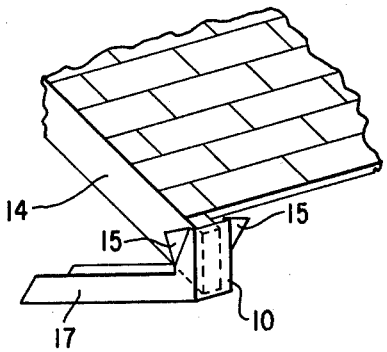

FIG. 1 is a pictorial view of one embodiment of my invention adapted to drain the water nearer the building to which it is attached, FIG. 2 is an alternate form of my device in which the water is directed laterally of the beam, and FIG. 3 illustrates the device of FIG. 1 as attached to the end beam of a roof.

DESCRIPTION

Briefly, my invention comprises a device for attachment to the roof beam to collect water from that beam and then to guide it elsewhere by means of a trough communicating with the collector.

More specifically, and referring to the drawings, my device comprises a trough shaped collector 10 having side walls 11 and a back wall 12. As shown in FIG. 3, the collector is preferably longer than the end of the beam 14 to which it is to be attached so that the wall 12 will extend well above the beam 14 to stop the flow of water down the roof and over the beam. The trough shape of this part is also preferably wider than the thickness of the beam so that water running along the sides of the beam will also be caught. Outwardly extending ears 15 may be provided on the sidewalls 11 to assist in collecting the water and deflecting it in the desired direction. It should be noted that while I normally fasten the back wall 12 directly to the end of the beam 14, it could be spaced therefrom by using spacers, washers or some similar sort of shim around the fastener (nail or screw) between the wall 12 and the end of the beam 14.

Water collected by the collector means 10 is led directly to a trough 17 which angles downward from the collector and can be directed to whatever location may be preferred for the discharge of the rain water. In the embodiment shown in FIGS. 1 and 3, this is simply directed back toward the building so that the water does not run off the beam onto peripheral sidewalks or the like. However, as shown in FIG. 2, the trough can be placed at other angles to the collector so that water can be deflected parallel to the edge of the building or in some other direction if that is thought desirable.

Thus, by my device, rain water from the end beams of buildings can be redirected to a more desirable drainage location.

I claim:

1. Water diverting means for run-off water from a roof having beams comprising deflector means adapted to be attached one end of to one of said beams, said deflector means embracing two opposite sides of said end trough means in communication with said deflector means adapted to receive water from said deflector means and conduct it to a discharge point.

2. The device of claim 1 in which said deflector means includes outwardly extending ears adapted to divert water on the sides of said beams into said trough.

3. The device of claim 2 in which said trough extends under said beams.

4. The device of claim 2 in which said trough extends laterally of said beam.

5. The device of claim 1 in which said deflector means is trough-shaped, said trough shape having sidewalls spaced from the sides of said beams.

* * * * *